United States Patent [19]

Spurr

[11] Patent Number: 4,911,360

[45] Date of Patent: Mar. 27, 1990

[54] PRECAST RAILWAY CROSSING SLAB

[75] Inventor: William A. Spurr, Kingston, Canada

[73] Assignee: Urban Transportation Development Corporation Limited, Kingston, Canada

[21] Appl. No.: 120,780

[22] Filed: Nov. 16, 1987

Related U.S. Application Data

[63] Continuation-in-part of Ser. No. 871,897, Jun. 9, 1986, abandoned.

[51] Int. Cl.[4] ..... E01C 9/04

[52] U.S. Cl. ..... 238/5; 238/8

[58] Field of Search ..... 238/3, 5–9

[56] References Cited

U.S. PATENT DOCUMENTS

| | | | |
|---|---|---|---|
| 1,996,574 | 4/1935 | Frazier | 238/8 |
| 2,081,352 | 5/1937 | Brown | 238/8 |
| 2,835,451 | 5/1958 | Goulding, Jr. | 238/8 |
| 3,469,783 | 9/1969 | Uralli et al. | 238/8 |
| 4,117,977 | 10/1978 | Whitlock | 238/8 |
| 4,147,304 | 4/1979 | Blyton | 238/8 |
| 4,289,273 | 9/1981 | Schmidt | 238/8 |
| 4,457,468 | 7/1984 | Hales et al. | 238/8 |

FOREIGN PATENT DOCUMENTS

| | | | |
|---|---|---|---|
| 931021 | 7/1963 | United Kingdom | 238/8 |

*Primary Examiner*—Andres Kashnikow

*Attorney, Agent, or Firm*—Fleit, Jacobson, Cohn, Price, Holman & Stern

[57] ABSTRACT

A modular railway crossing element is described having a slab member with a pair of open channels formed in its upper surface. The channels are substantially parallel and dimensioned to receive a pair of rails. Also described is a railway crossing utilizing the slab member and a method of forming a railway crossing.

31 Claims, 7 Drawing Sheets

PRECAST RAILWAY CROSSING SLAB

This application is a continuation-in-part of application Ser. No. 871,897, filed June 9, 1986, now abandoned.

The present invention relates to railway crossings.

Railway crossings are a common feature at the intersection of highways and rail tracks. It is desirable for the road surface to be substantially level with the top of the rails so as to minimize damage to the vehicles and prevent accidents. The surface of the road between the rails is commonly achieved by means of timber beams which are laid parallel to and on each side of the rails. A gap is formed between the rails and the timber beams to enable the train wheels to pass therethrough, while the top surface of the timber is level with the top surface of the rail to provide an even crossing for the automobile. A filler material such as gravel or asphalt is placed in the inner region of the track between the beams and on each of the approaches to the crossing in order to adjust the level of the crossing with that of the road bed.

In another type of crossing, concrete beams are used in place of timber beams and the gravel ballast are laid on railway ties both in between and outside the rails. Rubber pads are placed beneath the beams for shock absorbsion and levelling.

Problems arise in each of the above-mentioned types of railway crossings when attempts are made to minimize the discontinuities in the road bed in traversing the railway crossing. In many cases, the beams and the gravel are misaligned with respect to the road bed and the rails, causing abrupt changes in elevation which generate vibration within a vehicle as it passes over the railway crossing. This in turn can cause damage to the vehicle and discomfort to the occupants. In some extreme cases, this misalignment can cause loss of control of the vehicle and a subsequent accident.

Moreover, the installation and maintenance of these crossings is both time consuming and labor intensive resulting in maximum inconvenience to the users of both the road and railway.

It is therefore an object of the present invention to obviate or mitigate the above-mentioned disadvantages by providing a novel form of railway crossing and time saving procedure for constructing the same.

Broadly stated the invention comprises a modular railway crossing element having a slab member with a pair of open channels formed in its upper surface. The channels are substantially parallel and are dimensioned to receive a pair of rails.

In a preferred embodiment the slab is formed from a precast concrete material and with the open channels being substantially parallel to the longitudinal axis thereof. The slab has at least one face which is transverse to the longitudinal axis and has defined therein an alignment means to align the channels with the channels in an adjacent slab. Each end of the channel is provided with a flare for progressively inhibiting the lateral motion of the train wheels relative to the rails. A grouting passage extending through the slab and joining the upper surface with the lower surface of the slab is provided near each end thereof for the injection of a base forming material.

In another aspect of the present invention, the railway crossing comprises a first slab having a first pair of parallel panels formed in its upper surface and located on a railway crossing bed, aligned with a rail bed. A second slab, having a pair of parallel channels formed in its upper surface, is also located on the prepared bed and oriented in end to end relationship with the first slab in such a manner that the first and second pairs of channels are aligned with one another and with the rail bed.

In yet a further aspect, a method of forming a railway crossing comprises the steps of preparing a railway crossing bed between the adjacent ends of a rail bed, including a pair of rails, and a road bed, the rail crossing bed providing drainage and a firm slab receiving top surface of predetermined dimensions, locating on the top surface, a first slab having dimensions not exceeding the predetermined dimensions and a first pair of substantially parallel channels formed in its upper surface and dimensioned to receive a pair of rails, manipulating the first slab for levelling and alignment of the first pair of channels with reference to the road and rail beds, at least partially filling the voids between the lower surface of said first slab and said top surface so as to provide a permanent support, placing a covering material around the edges of the first slab, inserting a pair of rails into the first pair of channels, the wheel contacting portion of the rails being upwardly oriented therein, and fastening the rails in place.

Further features objects and advantages of the present invention will become evident following a detailed description, given by way of example only, of preferred embodiments as illustrated in the appended drawings in which FIG. 1 is a perspective view of a railway crossing.

Figure 1:
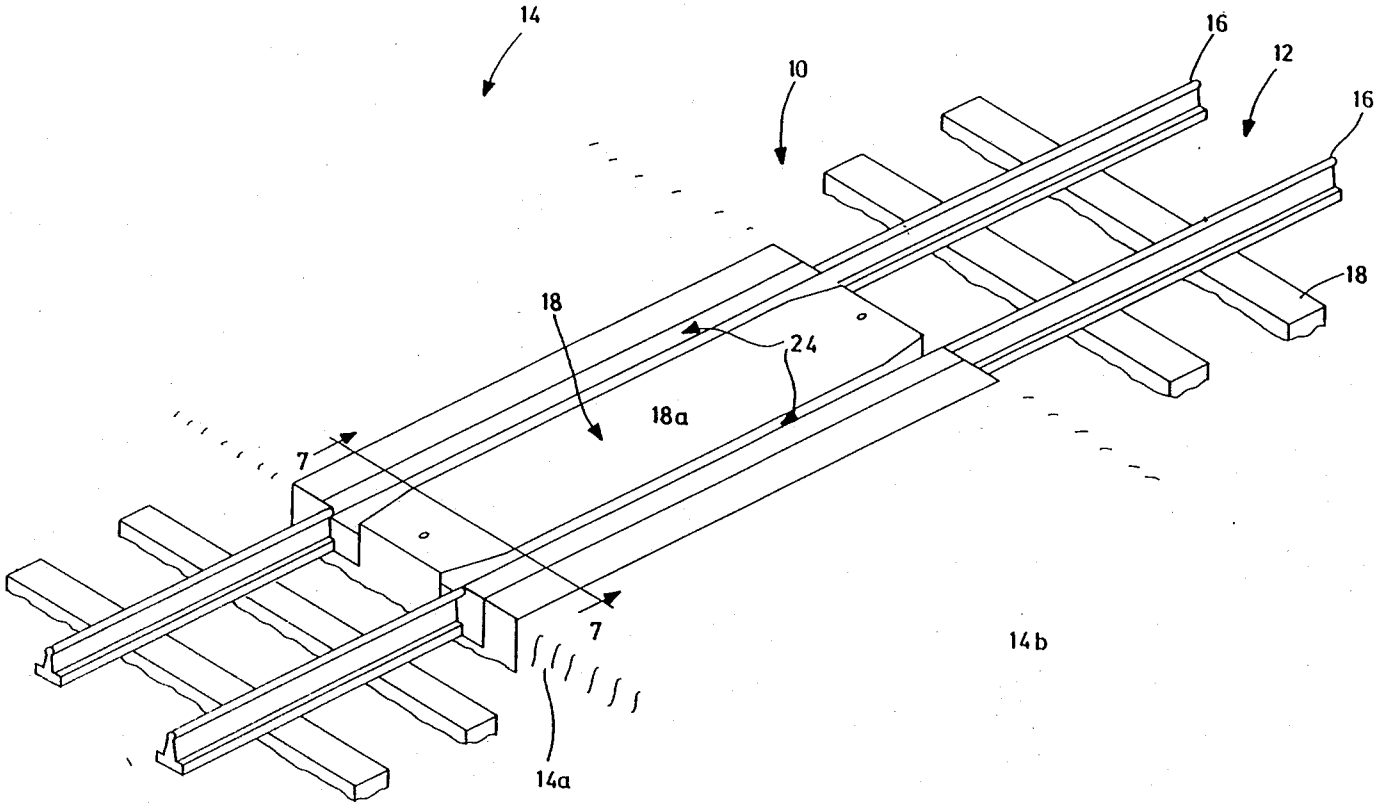

A railway crossing 10 is shown in FIG. 1 at the intersection of a railway track 12 and a road bed 14. The railway track 12 includes a pair of rails 16 which are fastened to spaced railway ties 18 to maintain the rails 16 in spaced relationship. The road bed 14 has a gravel substratum 14*a* and an asphalt surface 14*b* which provides a wear resistant surface. Located at the intersection of the road bed 14 and the rail bed 12 is a slab 18 which may be seen in better detail in FIGS. 3 to 7.

Figure 6:
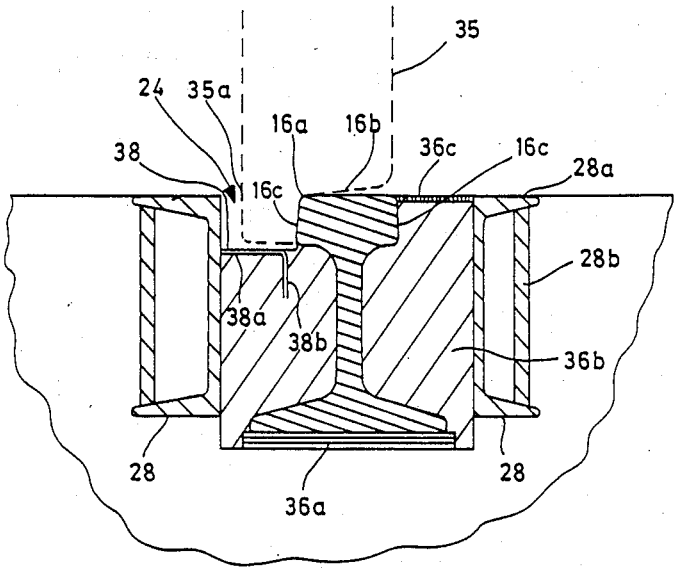
FIG. 6 is a further view the region enclosed by circle 6 of FIG. 5.

With particular reference to FIGS. 3 to 6, the slab 18, has upper and lower surfaces 18*a* and 18*b*, sides 18*c* and 18*d* and lateral end surfaces 18*e* and 18*f*. The slab 18 is formed from a precast concrete material which is reinforced by a matrix of reinforcing bars 20. The slab is of a weight ranging from about 12 to 20 tons and is preferably 18 tons, which provides a sufficient mass to dampen vertical and transverse forces exerted by a train on the crossing. Imbedded in the slab 18 are I-beams 22 which project laterally from the sides 18*c*, 18*d* to facilitate the handling of the slab 18. The slab 18 has a pair of substantially parallel channels 24 formed in the upper surface 18*a* which are dimensioned to receive rails 16. Each of the channels 24 has inner and outer side walls 24*b* and 24*c* respectively, the inner side walls 24*b* diverging at each end to provide a flared channel portion as shown at 26. In order to protect the channels in areas where environmental conditions require manual clearing of the channels by mechanical means, wear plates 28 are disposed on each of the side walls 24*b* and 24*c*. As shown in FIG. 6, the wear plates 28 have flanges 28*a* and spaced stringers 28*b* which are embedded in the side wall to retain them in place. Grouting passages 30 are located near each end and in the central region and extend through the slab 18 to join the upper surface 18*a* and the lower surface 18*b*.

Figure 9:
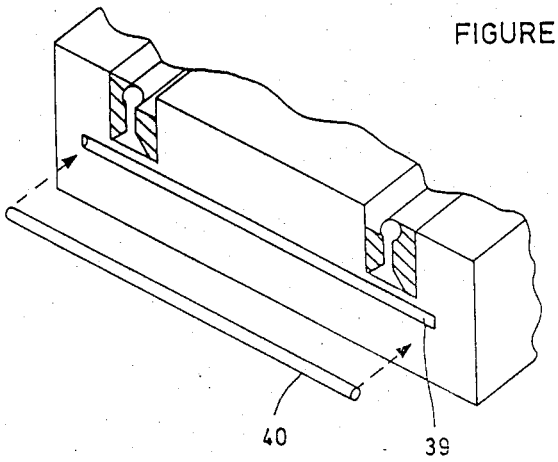
FIG. 9 is an assembly view of two elements in accordance with the alternative embodiment shown in FIG. 2.

A groove 39 is formed in each of the end surfaces 18*e*, 18*f* and has semi-circular cross section to receive an alignment rod 40 as shown in FIG. 9.

Figure 7:
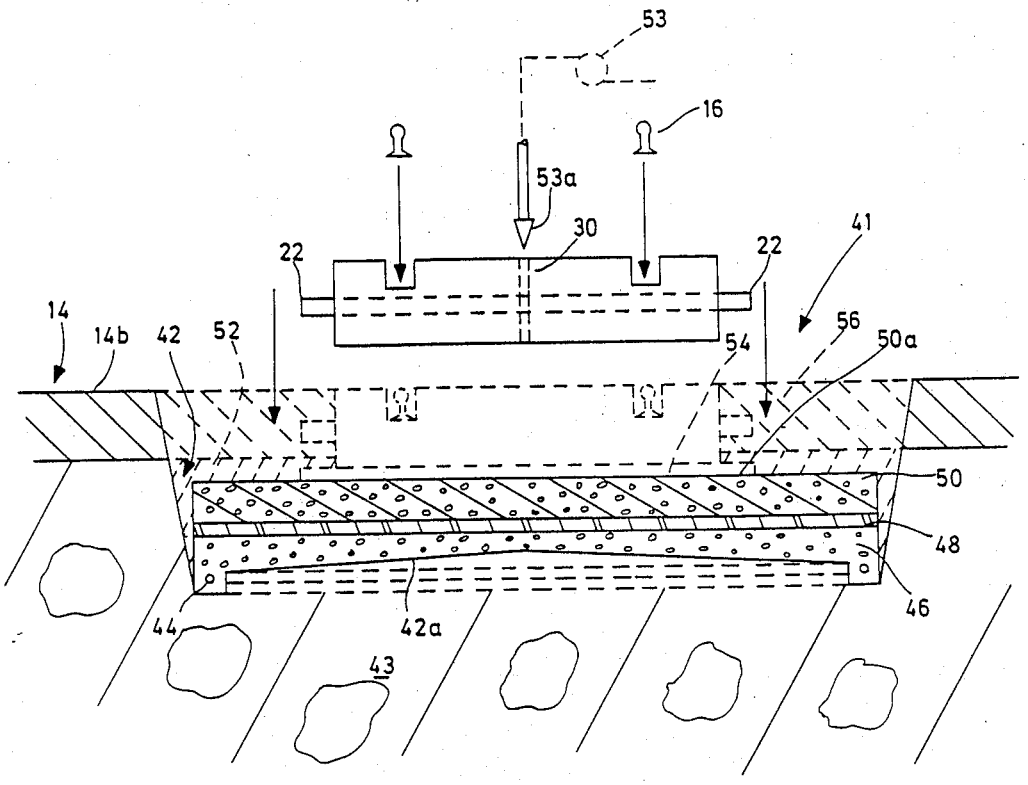
FIG. 7 is a partial assembly view on line 7—7 of FIG. 1.

Having descried the features of slab 18, attention will now be directed to the assembly of a rail crossing, which initially involves the preparation of a railway crossing bed 41 as is shown in FIG. 7.

The railway crossing bed 41 is formed in a cavity 42 which is excavated from the substratum 43. The cavity 42 has an outwardly sloping bottom surface 42*a* providing drainage of ground waters. These drain waters are removed by a drain pipe 44 located at the perimeter of the cavity 42. A first base layer 46 is formed on the bottom surface 42*a* and is comprised of a compacted ballast and crushed stone mixture. Placed on top of the first base layer 46 is a second base layer 48 of a shock suppressive material such as styrofoam. A third base layer 50 of compacted ballast and crushed stone material is located above the second layer 48. The third base layer 50 has an upper surface 50*a* which is levelled with reference to the rail and road beds 12 and 14 respectively.

The slab 18 is then placed on the upper surface 50*a* of the third base layer 50 with the assistance of the I-beams 22. The slab 18 is then levelled and aligned with reference to the rail and road beds 12 and 14 respectively, by supporting the beams 22 with suitable jacking or lifting devices until the upper surface 18*a* is level and at the desired height.

To support the slab 18 in the level position, a grouting material 54 is injected by means of a pump 53 equipped with a nozzle 53*a* through the passages 30 and spreads along the lower surface 18*b* to fill any voids and provide a stable support. A suitable grouting material is a sand-cement mix. Others include epoxy cement or an expandable foam equivalent thereof.

After the grout has cured sufficiently to take the weight of the slab 18, the area surrounding the slab 18 is backfilled as indicated at 52.

A particular feature of the crossing 10 is the size of the slab which, as mentioned above, provides sufficient dampening of the fluctuating loads exerted by a passing train, while at the same time enables the slab to be transported and installed on site by conventional equipment. This allows the railway crossing to be installed quickly and at a relatively small cost. Moreover, since the fluctuating loads exerted on the slab by the passing train are minimized, subsequent long term damage to the substratum is minimized, thereby providing an increased operating life.

A layer of asphalt 56 is then placed on the top surface of the bed and against the slab 18, thereby joining the top surface 18*a* with the top surface 14*b* of the road bed 14. The railway crossing 10 may then be completed by inserting the rails 16.

The rails 16 are inserted in the channels 24 with the wheel contacting surface 16*a* of each rail 16 upwardly oriented therein. The wheel contacting surface 16*a* includes both the top surface 16*b* which contacts the peripheral surface of a wheel indicated at 35 and the inner side surface 16*c* which contacts flanges 35*a* of the wheel. As can be better seen in FIG. 6, each rail 16 is located within the channel 24 by several bonding agents 36 in such a manner as to leave the side surface 16*c* of the rail 16, exposed. The first bonding agent 36*a* is a shock absorbing agent, such as TRACKELAST (a registered trade mark of James Walker & Co.) which provides a footing for the rail 16. By virture of its resilient shock absorbing nature, the bonding agent serves to suspend the rail in the channel 24 in such a way as to provide relative movement between the rail and the channel. A second bonding agent 36*b*, such as CORKELAST (a registered trade mark of James Walker & Co.), surrounds both sides of the rail body in such a manner as to fill the channel cavity adjacent the noncontacting surface 16*c* while partially filling the channel cavity adjacent the side surface 16*b* of the rail 16 to form a groove. Thus, the second bonding agent cooperates with the first bonding agent in suspending the rail in the channel 24 for relative movement therebetween. The upper surface of the second bonding agent 36*b* adjacent the noncontacting surface 16*b* side of the rail is covered with a third bonding agent 36*c*, such as TRACKELAST (a registered trade mark of James Walker & Co.), which provides a wear resistant surface. A second protective guard plate 38 comprising an angled member is positioned on the upper surface of the second bonding agent 36*b* adjacent the side surface 16*a*. The second wear plate 38 has a first flange 38*a* contacting the upper surface of the second bonding agent 36*b* whilst the second flange 38*b* is embedded in the second bonding agent 36*b*.

As the train passes, fluctuating loads are exerted on the rails. The shock absorbing layer provided by the bonding agent 36*a* reduces the size of force being transferred from the rail to the slab. This is particularly important to minimize the shocks exerted on the slab, so as to minimize damage thereto. This, combined with the dampening capabilities of the slab minimize the pressure variations exerted on the railway bed, thereby significantly increasing its operating life.

Figure 2:
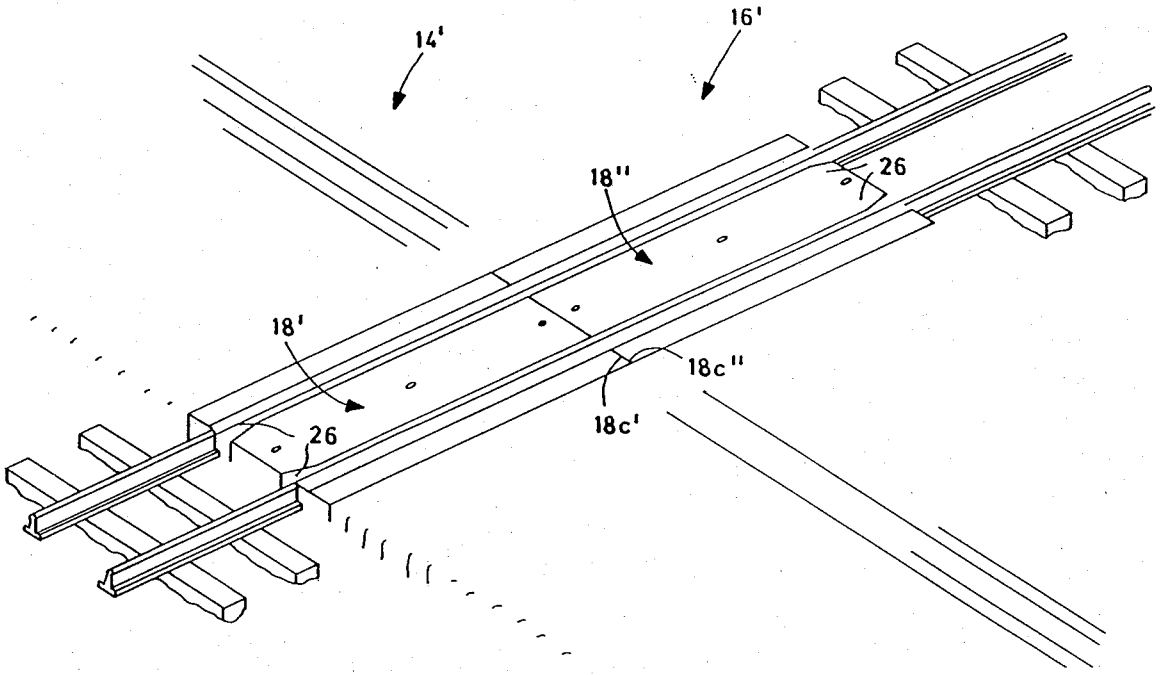
FIG. 2 is a perspective view of another railway crossing.
Figure 4:
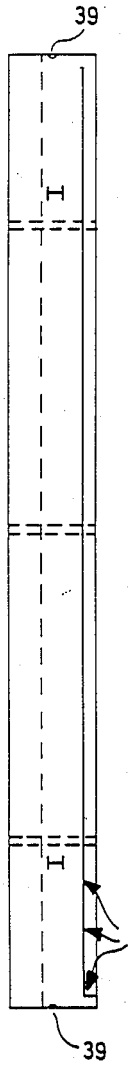
FIG. 4 is a sectional view on line 4—4 of FIG. 3.
Figure 3:
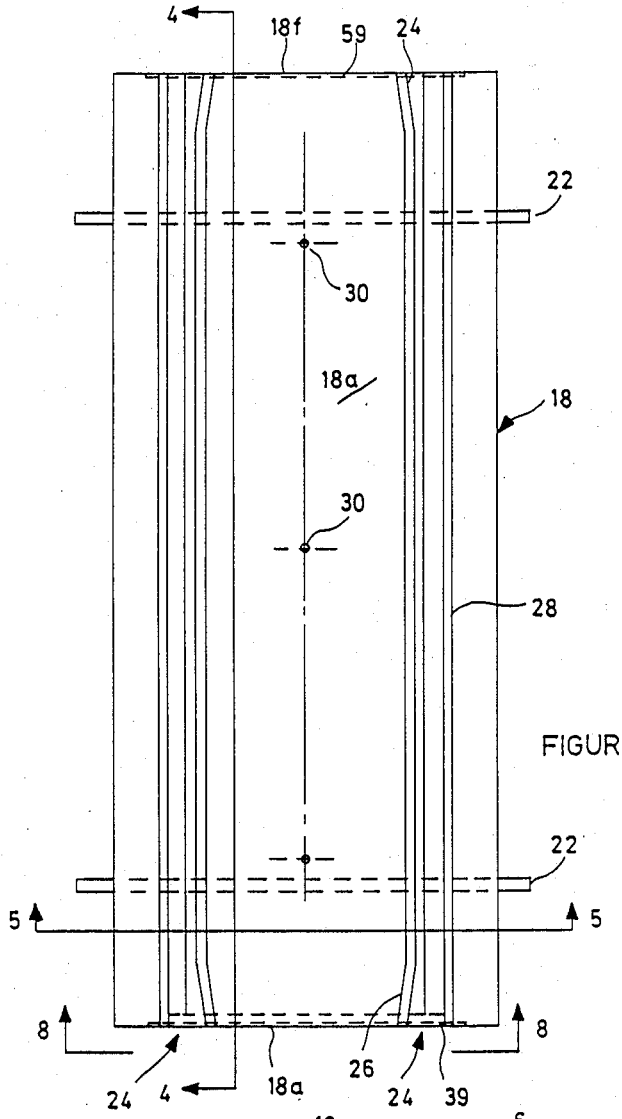
FIG. 3 is a plan view of one element shown in FIG. 1.
Figure 5:
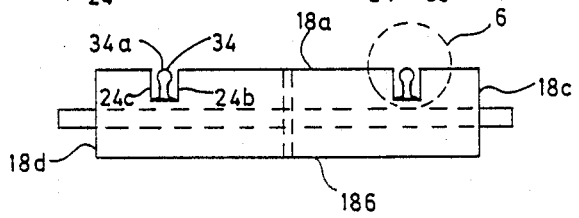
FIG. 5 is a sectional view on line 5—5 of FIG. 3.
Figure 8:
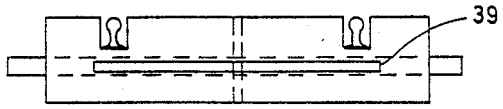
FIG. 8 is an end view on line 8—8 of FIG. 3 in accordance with the alternative embodiment shown in FIG. 2.

To provide the necessary length for wide roads it may be desirable to arrange a pair of slabs in end to end relationship as shown in FIG. 2.

In assembling a rail crossing having two slabs as shown in FIG. 2, the first slab 18′ is placed on the upper surface 50*a* of the third base layer 50 and aligned as described above. An alignment rod 40 is located in the channel 39 and a second slab 18″ is placed on the third base layer 50*a* with the transverse edges 18*e*′ and 18*e*″ of the slabs in abutment. The rod 40 provides a connection between the slabs 18 to facilitate alignment by means of a lifting mechanism such as a hydraulic jack. The grouting material is then injected beneath the second slab 18'' to form fourth base layer 54 beneath the second slab 18'' and the first slab 18' in order to provide a stable support. The asphalt top coat may then be applied as described above.

Figure 10:
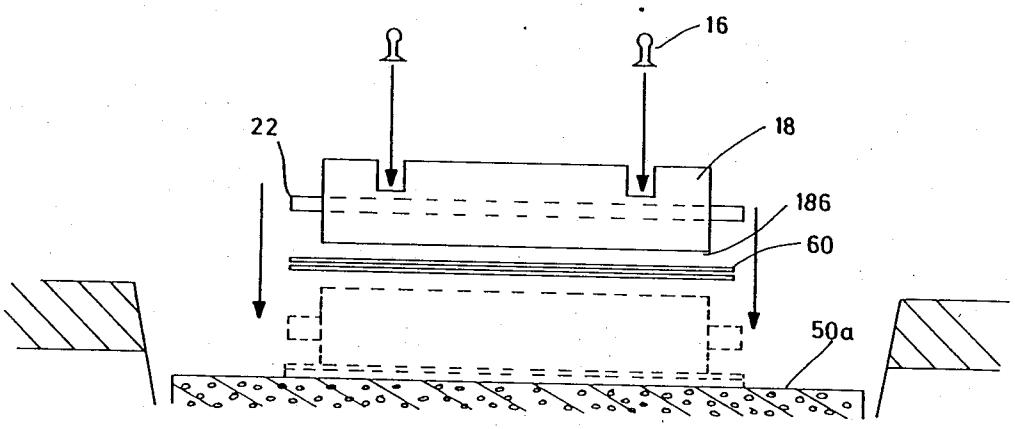
FIG. 10 is an assembly view of an alternative railway crossing.

In an alternative embodiment as shown in FIG. 10, a plurality of shims 60 are positioned on the upper surface 50*a*, with the slab 18 subsequently placed on shims 60. In this manner shims may be used to fill the voids between the lower surface 18*b* and the upper surface 50*a* to provide a permanent support in lieu of grouting material 54. The location and size of the shims will depend, in part, on the resulting shape, camber and pitch, of the upper surface 50*a* and lower surface 18*b*.

The railway crossing configuration as described above not only provides novel features of construction but also minimizes the effects of the crossover for both the train and the vehicle. As the train approaches, the wheels continuously move transversely on the rail, a movement known as "hunting", in response to the pitch, roll and cornering movements of the train. Upon entry of the channels, the flares progressively restrain this transverse motion of the wheels in order to prevent derailment of the train over the crossing.

The present railway crossing requires the alignment of the unitary slab 18 relative to the road and rail beds as opposed to a plurality of beams. The grouting passages 30 and the injection technique provide support after the alignment and levelling of the crossing thereby improving the safety of the vehicle and the train. As well, the life of the rail crossing is enhanced in part by the first and second wear plates 26 and 38 respectively which protect both the side walls 24*b*, 24*c* and the exposed second bonding agent 36*b* from wear and damage due to contact with dirt and the train wheels. Wear plates 26 and 38 also afford protection against contact with snow and ice removal equipment which is of particular importance in geographical regions experiencing extreme environmental conditions. Furthermore, long term settling effects are minimized by the preparation of a firm railway crossing bed with drainage for placement of the unitary slabs, which in turn dampen fluctuating loads exerted by a passing train.

Figure 11:
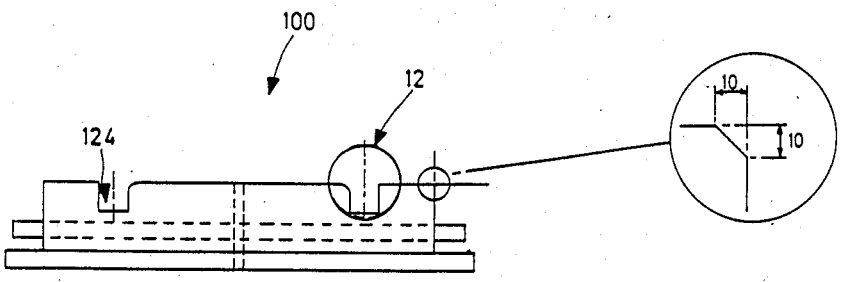
FIG. 11 is an end elevational view of a component of an alternative railway crossing.
Figure 12:
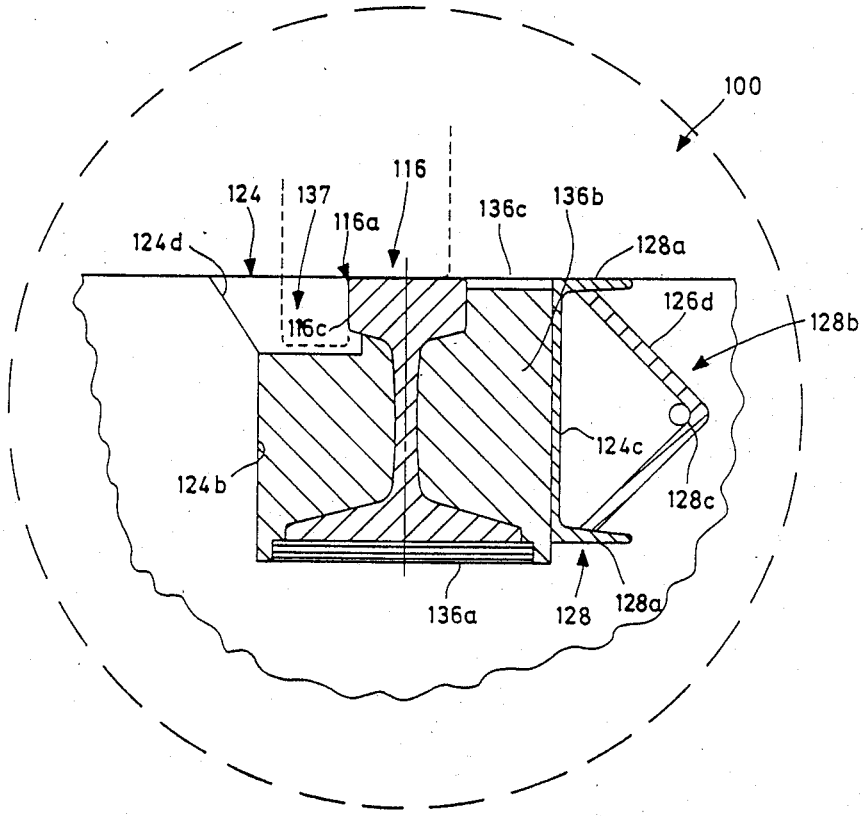
FIG. 12 is a magnified sectional view of a portion of another alternative railway crossing taken on circle 12 of FIG. 11 in another configuration.

Another embodiment of the slab is illustrated at 100 in FIG. 11, while FIG. 12 illustrates the slab 100 in an assembled railway crossing. The slab 100 provides a decrease in required maintenance in comparison with the previous embodiment. The differences in the slab 100 lie in the construction of the channels 124, which have an inner side wall 124*b* with a bevelled upper edge region 124*d* at an angle of inclination of approximately 45 degrees from vertical. The other side wall 124*c* is provided with a wear plate 128 in a similar manner to the previous embodiment but has a reinforcement bar 128*b* having portions 128*d* which extend in zig-zag fashion between flanges 128*a* of the wear plate 128 and a reinforcement network of bars in the concrete, one of which is shown at 128*e*.

As in the previous embodiment a rail 116, having a wheel contacting surface 116*a* including a flange contacting portion 116*b*, is provided in the channel and located on a first bonding agent 136*a*, forming a resilient shock absorbing pad, while a second bonding agent 136*b* is provided on each side of the rail 116. A third bonding agent 136*c* is again located on the top surface of the second bonding agent 136*b* on the outside of the rail. In this case, the surface of the second bonding agent 136*b* on the flange side of the rail 116 is left open and defines with the flange contacting portion 116*c* and the bevelled portion, a trough identified at 137.

The slab 100 substantially eliminates the need for manual removal of accumulated ice from the trough 137. This is due to the fact that, as a train wheel approaches the crossing, accumulated ice in the trough is pressed against the surface of the bonding agent 136*b*. Due to its resiliency, the bonding agent 136*b* deflects the ice against the bevelled edge causing the same to fail in tension.

Furthermore, the elimination of the need to clear manually the ice from the trough enables a wear plate adjacent the inner wall 124*b* as in the previous embodiment to be deleted, if desired, thereby simplifying the construction of the slab 100. It is to be understood that the bevelled edge portion may also be used on the previous embodiment, if desired.

It is to be understood that a multiple tracked crossing can also be implemented by placing pairs of slabs in parallel with their longitudinal edges in abutment. In this case, the slabs must be dimensioned to provide the required space between the pair of rails to accommodate the lateral dimensions of the train chassis. Should each of the tracks be restricted to one direction, flares 26 need only be located on the entry end of the channel. Also, other methods are available to fasten the rails in the grooves.

It is also to be understood that the weight of the slab is selected on the basis of the carrying capacity of conventional transport vehicles and the maximum weight of the train vehicle travelling over the slab with an axle load of 35 tons. Therefore, the weight of the slab may be increased if the carrying capacity of the available transport vehicles is increased and may be decreased below the 12 ton lower limit if the maximum axle load of the train is reduced.

I claim:

1. A modular railway crossing element to be placed on a substratum comprising a slab formed from concrete material having formed in its upper surface, a pair of substantially parallel open channels, said open channels having a bottom face, each bottom face constituting means to receive one of a pair of rails, suspension means for permitting relative movement between a rail and its associated bottom face, said suspension means constituting means to absorb a portion of a fluctuating load exerted by a train vehicle travelling on said rails, said slab having a mass sufficient to dampen a non-absorbed portion of said load and thereby to minimize variations in pressure exerted on said substratum.

2. A modular railway crossing element as defined in claim 1 wherein said slab is elongate with said open channels substantially parallel with respect to the longitudinal axis of said slab.

3. A modular railway crossing element as defined in claim 2 wherein said channels are oriented substantially parallel to and symmetrically disposed with respect to said longitudinal axis.

4. A modular railway crossing element as defined in claim 2 wherein said slab has at least one face transverse relative to said longitudinal axis, said modular railway crossing element further comprising alignment means associated with said transverse face to align said open channels with the open channels in an adjacent slab.

5. A modular railway crossing element as defined in claim 4, said alignment means including a channel formed in said transverse face and perpendicular with respect to said longitudinal axis for receiving an elongate alignment member.

6. A modular railway crossing element as defined in claim 5 wherein said channel is circular in cross section and dimensioned to receive an alignment rod.

7. A modular railway crossing element as defined in claim 1 further comprising at least one grouting passage extending through said slab to join the upper and lower surfaces thereof for the injection of a grouting material.

8. A modular railway crossing element as defined in claim 7 wherein one of said at least one grouting passage is located near each end and in the central region of said slab.

9. A modular railway crossing element as defined in claim 1 further comprising a wear element disposed along the sides of said open channels.

10. A modular railway crossing element as defined in claim 1, said modular railway crossing element further comprising a flare formed near at least one end for progressively inhibiting the lateral motion of an approaching train wheel relative to said rails.

11. A modular railway crossing element as defined in claim 1 wherein said suspension means includes a bonding agent for bonding said rail in said open channel.

12. A modular railway crossing element as defined in claim 11 further comprising shield means to be positioned adjacent the surface of said bonding agent for preventing contact between the surface of said bonding agent and objects exterior to said slab.

13. A modular railway crossing element as defined in claim 12, said shield means including a first flange element to contact the upper surface of said bonding agent adjacent the train wheel contacting portion of the rail.

14. A modular railway crossing element as defined in claim 13, wherein said shield means is an angled member having a second flange element depending from said first flange element to be embedded in said bonding agent.

15. A railway crossing element as defined in claim 11 wherein said open channel has a side wall to be adjacent a wheel flange contacting portion of said rail, said side wall has a region adjacent said upper surface which is bevelled so as to cause accumulated ice adjacent said wheel flange contacting portion to be deflected by said bonding agent under forces exerted by said wheel flange onto said bevelled edge, whereby said accumulated ice fails under tension.

16. A modular railway crossing element as defined in claim 1 wherein said suspension means includes a layer of resilient material located between said rail and said bottom faces.

17. A modular railway crossing element as defined in claim 1 wherein one side face of said open channel and said rail together define a region in said open channel to receive a wheel flange, said suspension means includes a layer of a resilient bonding agent having an upper face, said one side face being bevelled from said upper surface to the upper face of said layer of bonding agent, said bevelled side face and said layer of bonding agent together constituting means to fracture ice collected in said region and to displace said fractured ice therefrom under the action of said wheel flange.

18. A railway crossing comprising a first slab having an upper surface and a lower surface and a pair of substantially parallel first open channels formed in said upper surface, to receive a pair of rails, each of said first open channels having a bottom face, said first slab being located on a prepared railway crossing bed in alignment with a rail bed and a road bed traversing said rail bed, said rail bed including a pair of rails, said pair of rails positioned in and extending along said pair of first open channels, suspension means for permitting relative movement between said rail and said bottom face, said suspension means constituting means to absorb a portion of a fluctuating load exerted by a train vehicle travelling on said rails, said first slab having a mass sufficient to dampen a non-absorbed portion of said load and thereby to minimize variations in pressure exerted on said railway crossing bed.

19. A railway crossing as defined in claim 18 wherein said first slab is formed from a precast concrete material.

20. A railway crossing as defined in claim 18 wherein said first slab is provided with at least one grouting passage extending through said slab to join the upper and lower surfaces thereof for the injection of a grouting material, said grouting material to occupy voids beneath said lower surface and provide a permanent support, said voids being formed by discontinuities in said railway crossing bed and said lower surface, thereby to provide a stable support.

21. A railway crossing as defined in claim 18 further comprising at least one shim disposed between said lower surface and said railway crossing bed so as to provide a permanent support.

22. A railway crossing as defined in claim 18 further comprising a second slab having an upper surface and a lower surface, a pair of substantially parallel second open channels formed in said upper surface to receive said pair of rails, each of said second open channels having a bottom face, said second slab being located on said prepared railway crossing bed, aligned relative to said rail and road beds, and oriented in an end to end relationship with said first slab, said pair of second open channels being further aligned with reference to said pair of first open channels, such that said pair of rails are positioned in and extend along said pair of second open channels, suspension means for permitting relative movement between said rail and said bottom face, said suspension means constituting means to absorb a portion of a fluctuating load exerted by a train vehicle travelling on said rails, said second slab having a mass sufficient to dampen a non-absorbed portion of said load and thereby to minimize variations in pressure exerted on said railway crossing bed.

23. A railway crossing as defined in claim 22 wherein said first and second slabs are formed from a precast concrete material.

24. A railway crossing as defined in claim 22 wherein each of said first and second slabs have at least one passage extending through the slab to join the upper surface with the lower surface thereof for the injection of a grouting material, said grouting material to occupy voids beneath said lower surfaces, formed by discontinuities in said top and lower surfaces, thereby to provide a stable support.

25. A railway crossing as defined in claim 22 further comprising at least one shim disposed between the lower surface of each of said first and second slabs and the top surface of said railway crossing bed so as to provide a permanent support.

26. A method of forming a railway crossing comprising the steps of:

preparing a railway crossing bed at the intersection of a rail bed and a road bed, said railway crossing bed providing drainage and a firm slab receiving top surface of predetermined dimensions, locating on said top surface, a first slab having dimensions not exceeding said predetermined dimensions, an upper surface and a lower surface, a pair of substantially parallel first open channels formed in said upper surface to receive a pair of rails, each of said first open channels having a bottom face, manipulating said first slab to level and align said pair of first open channels with reference to said road bed and said rail bed, at least partially filling the voids between the lower surface of said first slab and said top surface so as to provide a permanent support, providing a suspension for each of said rails in said first open channels so that said rails are capable of relative movement with said bottom surface for absorbing a portion of a fluctuating load exerted by a train vehicle travelling on said rails, said slab suspension means for permitting relative movement between said rail and said bottom face, said suspension means constituting means to absorb a portion of a fluctuating load exerted by a train vehicle travelling on said rails, said first slab having a mass sufficient to dampen a non-absorbed portion of said load and thereby to minimize variations in pressure exerted on said railway crossing bed.

27. A method as defined in claim 26 wherein said first slab has at least one grouting passage extending through said slab to join the upper and lower surfaces of thereof, said step of at least partially filling said voids including injecting a grouting material in said at least one first grouting passage to occupy voids beneath said lower surface formed by discontinuities in said top and lower surfaces.

28. A method as defined in claim 26 wherein said step of at least partially filling said voids includes locating at least one shim between said lower and top surfaces.

29. A method as defined in claim 26 further comprising the steps of:

locating a second slab on said railway crossing bed in an end to end relationship with said first slab, said second slab having an upper surface and a lower surface and a pair of substantially parallel second open channels formed in said upper surface to receive said pair of rails, manipulating said second slab for levelling and alignment of said pair of second open channels with said pair of first open channels and with reference to said road bed and said rail bed, at least partially filling the voids between said lower surface and said top surface so as to provide a permanent support, inserting said pair of rails into said pair of second open channels, providing a suspension for each of said rails in said first open channels so that said rails are capable of relative movement with said bottom surface for absorbing a portion of a fluctuating load exerted by a train vehicle travelling on said rails, said slab suspension means for permitting relative movement between said rail and said bottom face, said suspension means constituting means to absorb a portion of a fluctuating load exerted by a train vehicle travelling on said rails, said second slab having a mass sufficient to dampen a non-absorbed portion of said load and thereby to minimize variations in pressure exerted on said railway crossing bed.

30. A method as defined in claim 29 wherein said second slab includes at least one second grouting passage extending through said slab to join the upper and lower surfaces thereof, wherein said step of at least partially filling said voids includes:

injecting a grouting material in said at least one second grouting passage to occupy voids beneath said lower surface formed by discontinuities in said top and lower surfaces.

31. A method as defined in claim 29 wherein said step of at least partially filling said voids includes locating at least one shim between said lower and top surfaces.

* * * * *